US007495629B2

(12) United States Patent
Parsche et al.

(10) Patent No.: US 7,495,629 B2
(45) Date of Patent: Feb. 24, 2009

(54) SURFACE MOUNTABLE INVERTED-F ANTENNA AND ASSOCIATED METHODS

(75) Inventors: Francis Eugene Parsche, Palm Bay, FL (US); Robert Patrick Maloney, Palm Bay, FL (US); Robert Nathan Lavallee, West Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 731 days.

(21) Appl. No.: 11/265,698

(22) Filed: Nov. 2, 2005

(65) Prior Publication Data

US 2007/0096988 A1 May 3, 2007

(51) Int. Cl.
*H01Q 1/38* (2006.01)

(52) U.S. Cl. ..... 343/846; 343/700 MS

(58) Field of Classification Search ..... 343/700 MS, 343/702, 745, 846
See application file for complete search history.

(56) References Cited

U.S. PATENT DOCUMENTS 6,469,673 B2 * 10/2002 Kaiponen ..... 343/703
6,717,548 B2 * 4/2004 Chen ..... 343/700 MS
6,903,693 B1 * 6/2005 Lee et al. ..... 343/702

* cited by examiner

*Primary Examiner*—Michael C Wimer
(74) *Attorney, Agent, or Firm*—Allen, Dyer, Doppelt, Milbrath & Gilchrist, P.A.

(57) ABSTRACT

A microstrip slot dipole antenna of the inverted F type, includes a coplanar feed, and is suitable for easy peel-and-stick adhesive mounting. The antenna includes a ground plane, a dielectric layer, a horizontal element and a pair of spaced apart vertical elements depending therefrom defining an inverted F antenna above the ground plane with the dielectric layer therebetween. The pair of vertical elements may be conductive vias. A first antenna feed point is on an upper surface of the horizontal element, and a second antenna feed point is on an upper surface of a second vertical element of the spaced apart vertical elements. The second feed point may be a conductive pad on the dielectric layer spaced apart from a first vertical element and insulated from the horizontal element.

22 Claims, 5 Drawing Sheets

(VSWR RESPONSE)

(RADIATION PATTERN
COORDINATE SYSTEM)

(XY PLANE RADIATION PATTERN)

(YZ PLANE RADIATION PATTERN)

(ZX PLANE RADIATION PATTERN)

SURFACE MOUNTABLE INVERTED-F ANTENNA AND ASSOCIATED METHODS

FIELD OF THE INVENTION

The present invention relates to the field of wireless communications, and, more particularly, to antennas and related methods.

BACKGROUND OF THE INVENTION

Inverted-F antennas are used in wireless communications systems including mobile telephones, pagers, Global Positioning System (GPS), wireless LAN, WiFi, aircraft, locomotives, vehicles, radiolocation devices etc. Inverted-F antennas typically include a linear (i.e., straight) conductive element, e.g. a wire, that is maintained in spaced apart relationship with respect to a ground plane. They are especially useful where a low profile antenna is needed, one that does not stand tall above communications device, or mobile platform.

The inverted-F antenna is essentially a shunt fed inverted-L antenna, excited by a feed tap. That is, the antenna is tapped at a distance from the base to provide a desired driving point resistance. Thus, any resistance level may be obtained by adjusting the tap position. The inverted-F antenna may be preferred to the inverted-L antenna because it may not need an external matching network and may allow independent adjustment of the resonant frequency of the antenna and resistance level. In general, the overall length of the inverted-F antenna (height plus length) is approximately one-quarter wavelength at the resonant frequency.

The planar inverted-F antenna (PIFA) is a derivative of the inverted-F antenna in which the top wire is coplanar with a plate. This has been shown to lower the radiation Q and thus broaden the frequency response of the antenna while still retaining the desirable characteristics of the wire inverted-F antenna. PIFAs are typically used within wireless communication devices where externally mounted antennas are less desirable.

Conventional inverted-F antennas, by design, resonate within a narrow frequency band, as compared with other types of antennas, such as helices, monopoles and dipoles. Examples of inverted-F antennas are described in U.S. Pat. Nos. 5,684,492 and 5,434,579, for example.

The feed structure is typically a coaxial cable, and for inverted-F antennas that are mountable on a surface, such as on a vehicle, the feed must penetrate the surface to be connected to the antenna. This may make mounting difficult on some surfaces.

SUMMARY OF THE INVENTION

In view of the foregoing background, it is therefore an object of the present invention to provide an inverted-F antenna that is more readily mountable on a surface where it may not be desired to have the feedline penetrate the surface.

This and other objects, features, and advantages in accordance with the present invention are provided by an antenna comprising a ground plane, a dielectric layer, a horizontal element and a pair of spaced apart vertical elements depending therefrom defining an inverted F antenna above the ground plane with the dielectric layer therebetween. A first antenna feed point is on an upper surface of the horizontal element, and a second antenna feed point is on an upper surface of a second vertical element of the spaced apart vertical elements. The second feed point may be a conductive pad on the dielectric layer spaced apart from a first vertical element and insulated from the horizontal element.

A tuning element, such as a tunable capacitor, may be connected between the horizontal element and the ground plane. Furthermore, the dielectric layer may be a printed circuit board (PCB), and the pair of spaced apart vertical elements may be conductive vias within the PCB. The first vertical element of the spaced apart vertical elements may be a plurality of side-by-side conductive vias in the PCB. The second vertical element may be electrically insulated from adjacent portions of the horizontal element, and may be electrically connected to the ground plane. The ground plane may comprise a continuous electrically conducting plate.

An antenna feed structure, such as a coaxial feed cable, or microstrip feedline, may be connected to the first and second antenna feed points. The coaxial feed cable may include an outer conductor connected to the first antenna feed point, and an inner conductor connected to the second antenna feed point. The coaxial feed cable may extend outwardly from an end of the horizontal element adjacent the first vertical element.

Objects, features, and advantages in accordance with the present invention are provided by a method of making an antenna comprising: forming a ground plane on a dielectric layer, such as a printed circuit board (PCB); forming a horizontal element and a pair of spaced apart vertical elements, such as conductive vias, depending therefrom to define an inverted F antenna above the ground plane with the dielectric layer therebetween; forming a first antenna feed point on an upper surface of said horizontal element; and forming a second antenna feed point on an upper surface of a second vertical element of the spaced apart vertical elements.

The method may also include connecting at least one tunable capacitor between the horizontal element and the ground plane. Forming a first vertical element of the spaced apart vertical elements may comprise forming a plurality of linearly positioned conductive vias, while forming the second vertical element may comprise electrically insulating the second vertical element from adjacent portions of the horizontal element and electrically connecting the second vertical element to the ground plane. Again, the method may include connecting a coaxial feed cable to the first and second antenna feed points including connecting an outer conductor to the first antenna feed point, and an connecting an inner conductor to the second antenna feed point.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and the thicknesses of various layers may be exaggerated for ease of explanation.

A low profile inverted-F antenna in accordance with the present invention will now be described with reference to FIGS. 1-2. The inverted-F antenna is easily mountable on a surface without the need for the feedline to penetrate the surface. Such an inverted-F antenna may be used in wireless communications systems including mobile telephones, pagers, Global Positioning System (GPS), wireless LAN, WiFi, aircraft, locomotives, vehicles, radiolocations devices etc. As discussed above, the typical feed structure of a conventional surface mountable inverted-F antenna is typically a coaxial cable, and the feed must penetrate the surface to be connected to the antenna. The inverted-F antenna of the present invention does not require the feed to penetrate the surface, e.g. of the vehicle.

Figure 1:
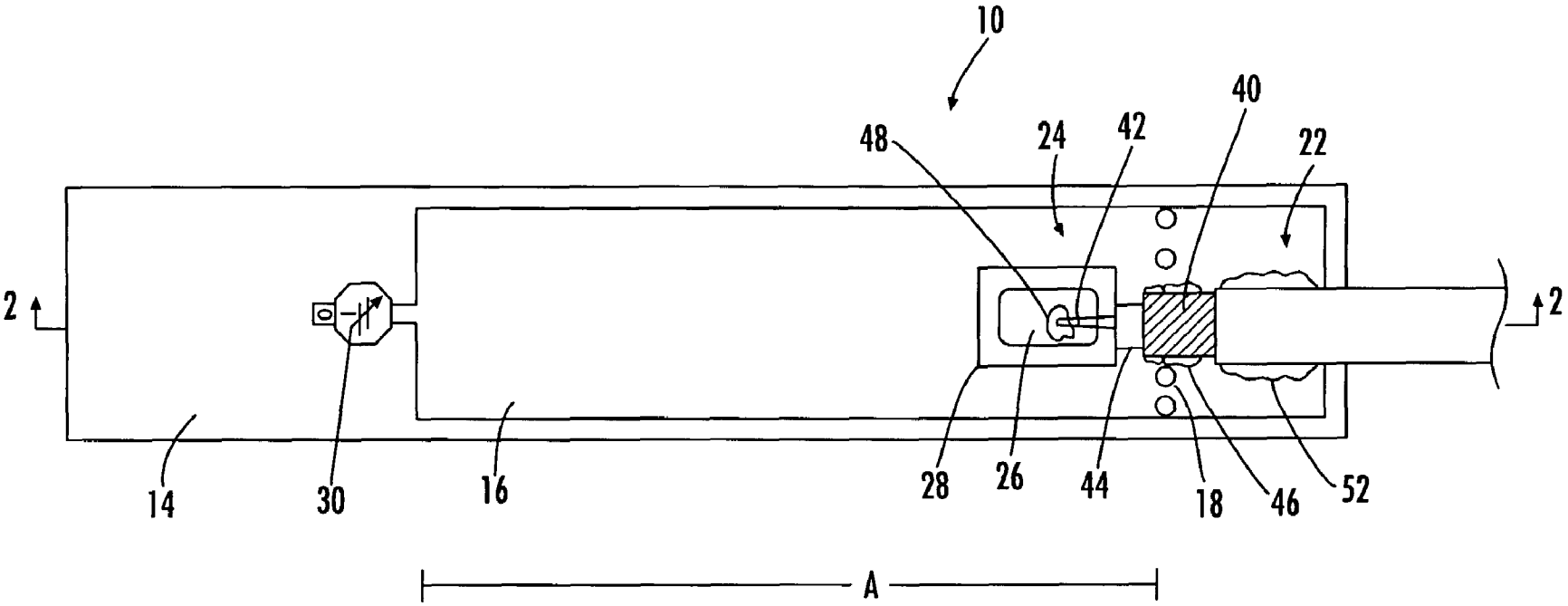
FIG. 1 is a plan view of an inverted-F antenna and inset feed structure in accordance with the present invention.
Figure 2:
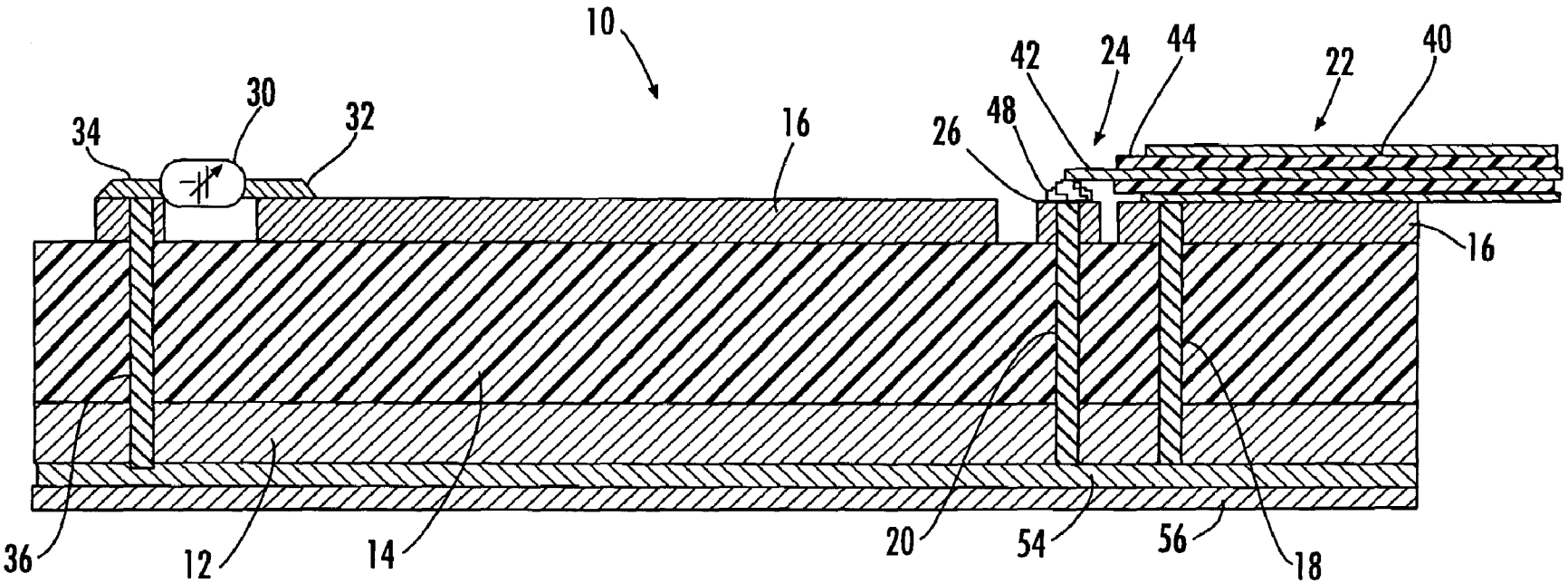
FIG. 2 is a cross-sectional view of the antenna including the inset feed structure taken along the line 2-2 in FIG. 1.
Figure 3:
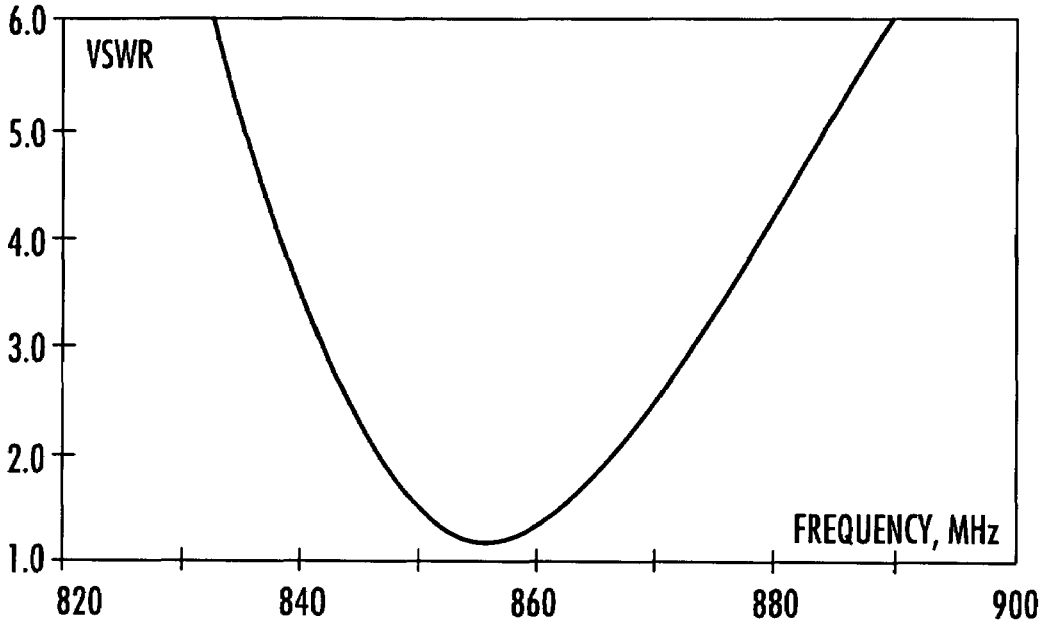
FIG. 3 is a graph of the VSWR of the antenna of FIG. 1.

Referring initially to FIGS. 1 and 2, the antenna 10 includes a ground plane 12, a dielectric layer 14, a horizontal element 16 and a pair of spaced apart vertical elements 18, 20 depending therefrom defining an inverted F antenna above the ground plane with the dielectric layer therebetween. The horizontal element 16 and the ground plane 12 are conductive printed layers e.g. formed of copper. The ground plane 12 comprises a continuous electrically conductive plate. The ground plane 12, dielectric layer 14, horizontal element 16 and pair of spaced apart vertical elements may define a printed circuit board (PCB).

As illustrated, the pair of spaced apart vertical elements 18, 20 are conductive vias within the PCB dielectric layer 14. Such conductive vias may be formed using known printed circuit board techniques as would be appreciated by those skilled in the art, such as plating. The first vertical element 18 of the spaced apart vertical elements may be a plurality of side-by-side or linearly positioned conductive vias in the PCB 14 as best shown in FIG. 1. The second vertical element 20 is electrically insulated from adjacent portions of the horizontal element 16, e.g. through opening 28, and is electrically connected to the ground plane 12.

A first antenna feed point 22 is on an upper surface of the horizontal element 16, and a second antenna feed point 24 is on an upper surface of the second vertical element 20 of the spaced apart vertical elements. The second feed point 24 may be a conductive solder pad 26, on the dielectric layer 14 spaced apart from a first vertical element 18 and insulated, via opening 28 from the horizontal element 16.

A tuning element 30, such as a variable capacitor, may be connected, via trace or solder 32, 34 at the open end of inverted-F antenna 10 to the horizontal element 16. The tuning element 30 is also connected to the ground plane 12 through solder 34 and conductive via 36.

An antenna feed structure, such as a coaxial feed cable or microstrip feedline, forms an inset feed and may be connected to the first 22 and second antenna feed points 24. Such a coaxial feed cable may include an outer conductor 40, such as a conductive braid, connected, e.g. via solder 46, to the first antenna feed point 22, and an inner conductor 42 connected, e.g. via solder 48, to the second antenna feed point 24 or conductive pad 26. A coaxial cable dielectric 44 preferably extends out from the outer conductor 40 towards the second antenna feed point 24 to insulate the inner conductor 42 from surrounding conductive areas, such as the horizontal element 16 and first vertical element or conductive vias 18. As illustrated, the coaxial feed cable extends outwardly from an end of the horizontal element 16 adjacent the first vertical element 18.

The length A of the horizontal element 16 from the first vertical element 18 to the open end of the inverted-F antenna sets the frequency of operation. The length A of the inverted-F antenna is preferably ¼ wavelength. The tunable element 30 or variable capacitor is for fine tuning the frequency of the inverted-F antenna 10. The inverted-F antenna is versatile however, in that it can operate at natural or forced resonance. Tunable element 30 can, for instance, have a large capacitance to shorten length A by capacitive loading. Length A can be as short 1/20 wavelengths in such instances, with tradeoffs in gain and gain bandwidth.

Also, because the bottom surface of the present invention is a ground plane, this inverted-F antenna can be mounted on any metal or non-metal surface, providing an easy to use antenna for consumer use.

Importantly, because the inventions feed structure does not penetrate the antenna mounting surface, the antenna can easily be mounted. For example, the invention may have an adhesive back 54, with wax paper 56 protecting the adhesive until customer use providing a convenient antenna for consumers. Preferentially, the adhesive may be conductive to take advantage of metal surfaces. Such a low-profile antenna may be easily utilized, in a variety of wireless communications systems, as a "Stick On Antenna" or "Peel And Stick Antenna".

Figure 4:
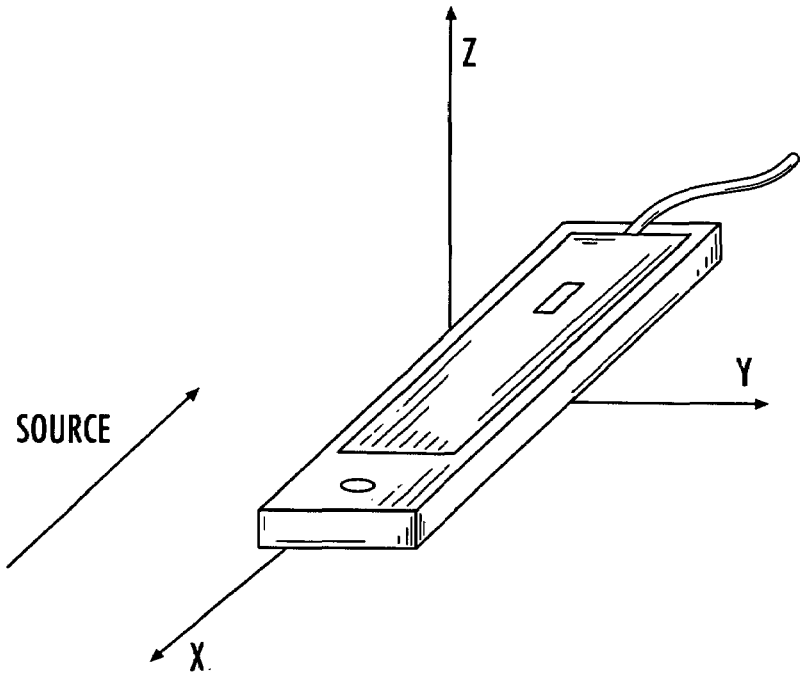
FIG. 4 is the radiation pattern coordinate system relative to the antenna of FIG. 1.
Figure 5A:
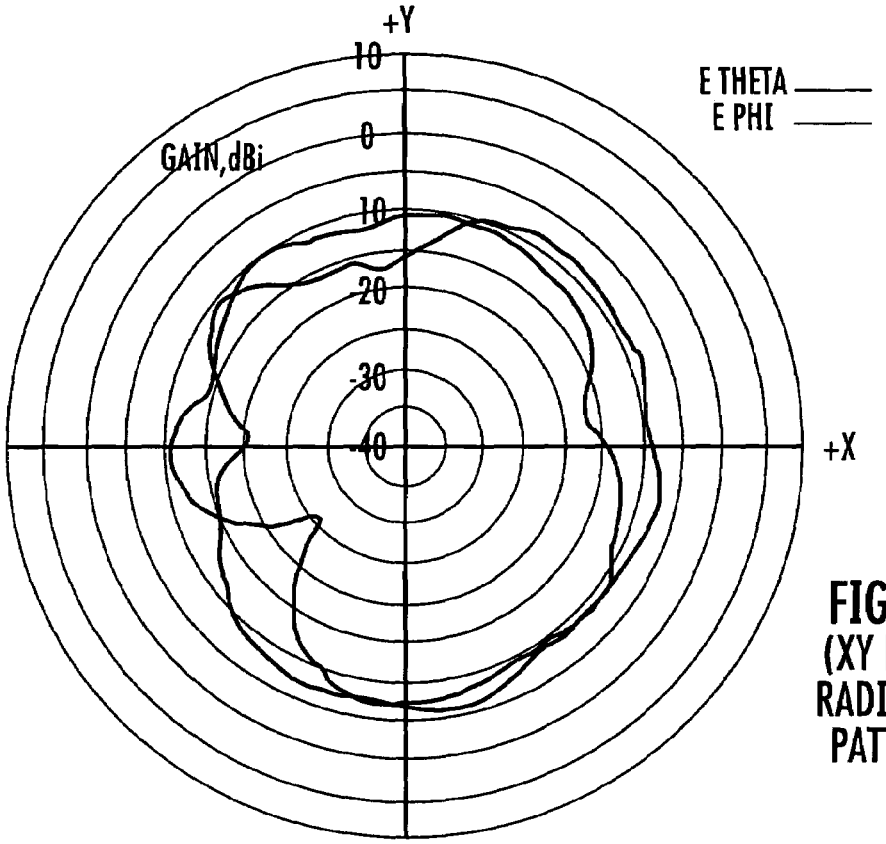
FIGS. 5A, 5B, and 5C are the principle plane radiation patterns, measured from the antenna of FIG. 1.
Figure 5B:
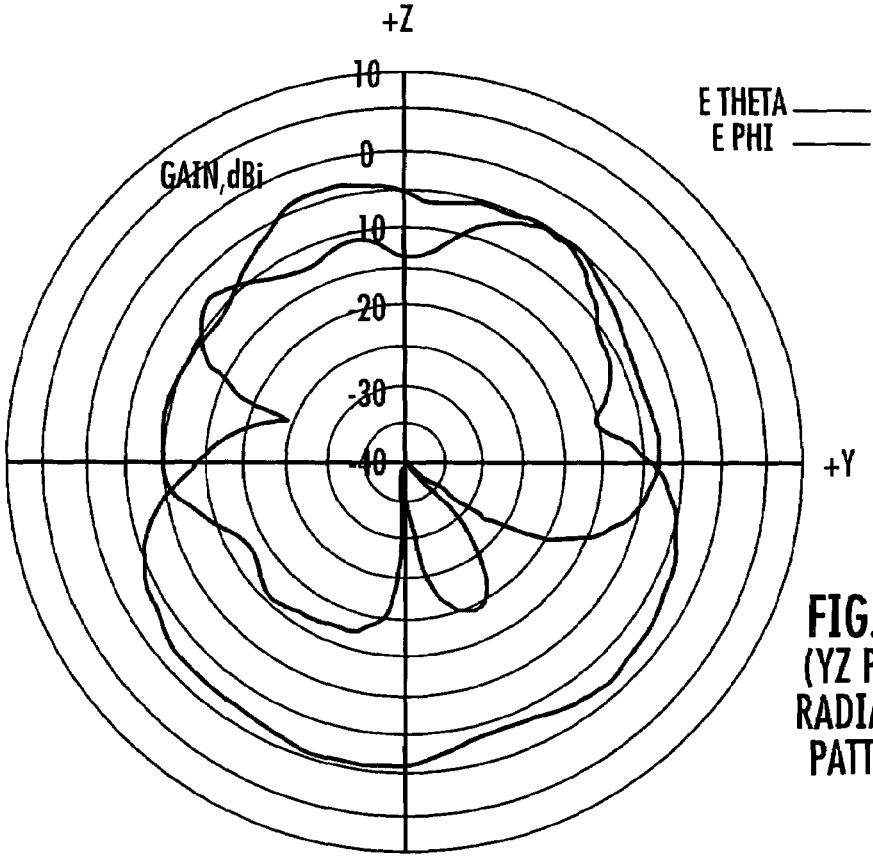
Figure 5C:
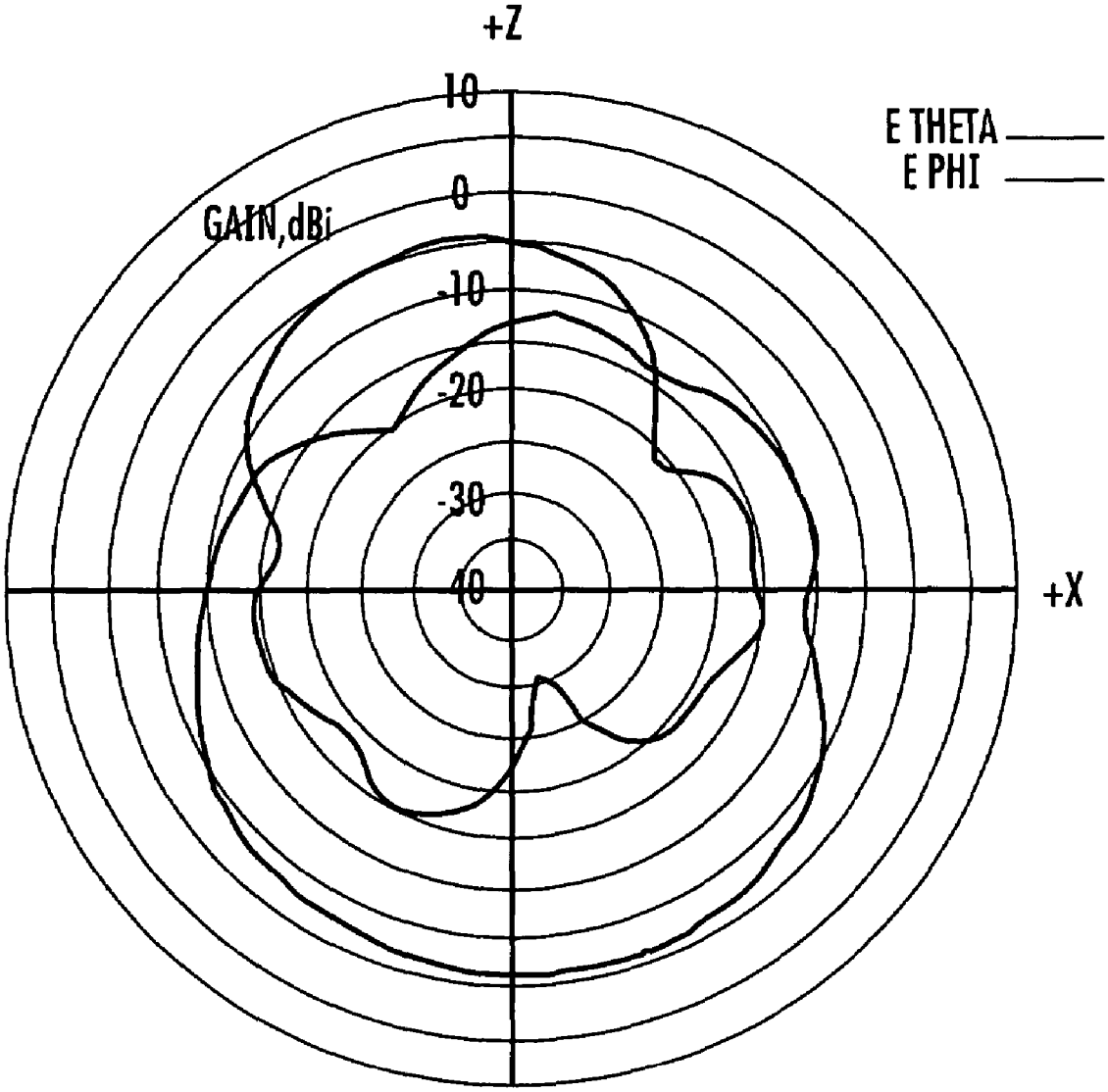

An example of an inverted-F antenna in accordance with the present invention is summarized in the table below. The vertical and horizontal far fields of the antenna is illustrated in the radiation patterns of FIGS. 5A-5C relative to the radiation pattern coordinate system illustrated in FIG. 4.

Example Surface Mountable Inverted F Antenna

| Parameter | Performance | Method |
|---|---|---|
| Gain | −1 dBi | Measured |
| Frequency | 858 Mhz Adjustable/Scalable | Measured |
| Polarization | Vertical | Measured |
| Elevation Pattern | Approximately Hemispherical | Measured |
| Azimuth Pattern | Omnidirectional In Nature | Measured |
| VSWR | 2.0 to 1 or less at Fo | Measured |
| 3 dB Gain Bandwidth | 1.77 percent | Measured |
| Size | 0.01 × 0.034 × 0.24 Wavelengths, In Substrate | Measured |
| Substrate | Teflon Based Printed Circuit Board | Specified |
| Mounting | Adhesive or Screws | Specified |

The present invention has the unique feature of "grounding" the coax cable center conductor to the antenna's bottom/mounting surface, and operates at about 180 degree phase difference from a conventional inverted-F antenna. In a sense, the present invention forms an inverted-inverted F antenna. The present invention antenna is of course completely compatible with conventional inverted F and other antennas, as will be appreciated by those skilled in the art.

In one analysis, the inverted F antenna is considered as a ¼ wave skeleton slot antenna, and in another as a radiating transmission line, microstrip in the present case. The current and voltage relationship along the line are sinusoidal and inverse to each other, forming a tangent function. Additionally, the radiation resistance of the structure may be represented as a loading resistance on the end of the structure, allowing a transmission line and circuit equivalent models to be constructed.

An empirical design procedure for the present invention is simply to trim the overall length so as to cause resonance at the desired frequency of operation, and to vary the tap point position for the coax feed to obtain the desired driving point resistance. Typically, the overall length of the radiating section is about 0.24 wavelengths in the transmission line substrate material, and the tap point is about 0.06 wavelengths from the grounded end, for a 50 ohm driving point resistance. The resistance and reactance are separately controlled by the overall length and tap point respectively.

Analytically, the length required for resonance in the present invention may be calculated as follows:

$$l=(1/4)k\,\lambda_{air}\,1/(\mu_r\epsilon_r)^{1/2}\text{ meters}$$

Where:

l=Length of the radiating (microstrip trace) portion of the present invention, from the grounded end to the open circuit end; $\lambda_{air}$=Radio wavelength in air or free space=300/operating frequency in Mhz; $\mu_r$=Relative permeability or magnetic constant of substrate. Equal to 1 for dielectric only materials; $\epsilon_r$=Relative permittivity or dielectric constant of substrate; k=Fringing factor, from stray near fields not captured by dielectric. A typical value is 1.04, particularly when the microstrip radiating trace is wide.

This antenna can radiate by separation of charge at the ungrounded end of the structure, and by conveyance of charge near the grounded end vias at vertical elements 18. The radiation mechanisms correspond to dipole and loop antennas respectively. When the thickness of this antenna is thin however, the dipole mode of radiation is predominant, as the loop aperture at the grounded end is small. Inverted F antennas are effective even when the radiating section is extremely close to the ground plane, a valuable property. Instantaneous gain bandwidth and thickness do however trade with each other, with the bandwidth narrowing as the thickness is diminished.

A method aspect of the invention is directed to making an antenna including forming a ground plane 12 on a dielectric layer 14, such as a printed circuit board (PCB), and forming a horizontal element 16 and a pair of spaced apart vertical elements 18, 20, such as conductive vias, depending therefrom to define an inverted F antenna above the ground plane with the dielectric layer therebetween. A first antenna feed point 22 is formed on an upper surface of the horizontal element 16, and a second antenna feed point 24 is formed on an upper surface of the second vertical element 20 which may include conductive pad 26.

The method may also include connecting at least one tunable capacitor 30 between the horizontal element 16 and the ground plane 12. Forming the first vertical element 18 of the spaced apart vertical elements may comprise forming a plurality of linearly positioned conductive vias, while forming the second vertical element 20 may comprise electrically insulating the second vertical element from adjacent portions of the horizontal element 16 and electrically connecting the second vertical element to the ground plane 12. Again, the method may include connecting a coaxial feed cable to the first 22 and second 24 antenna feed points including connecting an outer conductor 40 to the first antenna feed point, and an connecting an inner conductor 42 to the second antenna feed point.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna comprising:

a ground plane;

a dielectric layer;

a horizontal element and a pair of spaced apart vertical elements depending therefrom defining an inverted F antenna above said ground plane with said dielectric layer therebetween;

a first antenna feed point on an upper surface of said horizontal element; and a second antenna feed point on an upper surface of a second vertical element of the pair of spaced apart vertical elements.

2. The antenna according to claim 1, further comprising at least one tuning element connected between said horizontal element and said ground plane.

3. The antenna according to claim 2, wherein said at least one tuning element comprises at least one tunable capacitor.

4. The antenna according to claim 1, wherein the pair of spaced apart vertical elements comprises conductive vias within the dielectric layer.

5. The antenna according to claim 4, wherein a first vertical element of the pair of spaced apart vertical elements comprises a plurality of conductive vias in side-by-side relation.

6. The antenna according to claim 1, wherein said second vertical element is electrically insulated from adjacent portions of said horizontal element.

7. The antenna according to claim 1, wherein said second vertical element is electrically connected to said ground plane.

8. The antenna according to claim 1, wherein said ground plane comprises a continuous electrically conducting plate.

9. The antenna according to claim 1, further comprising a coaxial feed cable connected to said first and second antenna feed points.

10. The antenna according to claim 9, wherein said coaxial feed cable comprises an outer conductor connected to said first antenna feed point, and an inner conductor connected to said second antenna feed point.

11. The antenna according to claim 10, wherein said coaxial feed cable extends outwardly from an end of said horizontal element adjacent said first vertical element.

12. An antenna comprising:

a printed circuit board (PCB) comprising a dielectric substrate, a ground plane on a first side of the dielectric substrate, a horizontal element on a second side of the dielectric substrate opposite the ground plane, at least one first conductive via adjacent a first end of the horizontal element and connecting the horizontal element to the ground plane through the dielectric substrate, a conductive pad on the second side of the dielectric substrate spaced apart from the at least one first conductive via and insulated from the horizontal element, a second conductive via connecting the conductive pad to the ground plane through the dielectric substrate; and a coaxial feed cable connected to said horizontal element and conductive pad on the second side of the dielectric substrate.

13. The antenna according to claim 12, further comprising at least one tunable capacitor connected between said horizontal element and said ground plane.

14. The antenna according to claim 12, wherein the at least one first conductive via comprises a plurality of linearly positioned conductive vias.

15. The antenna according to claim 12, wherein said coaxial feed cable comprises an outer conductor connected to said horizontal element, and an inner conductor connected to said conductive pad.

16. A method of making an antenna comprising:

forming a ground plane on a dielectric layer;

forming a horizontal element and a pair of spaced apart vertical elements depending therefrom to define an inverted F antenna above said ground plane with said dielectric layer therebetween;

forming a first antenna feed point on an upper surface of said horizontal element; and forming a second antenna feed point on an upper surface of a second vertical element of the spaced apart vertical elements.

17. The method according to claim 16, further comprising connecting at least one tunable capacitor between said horizontal element and said ground plane.

18. The method according to claim 16, wherein forming the pair of spaced apart vertical elements comprises forming conductive vias within the dielectric layer.

19. The method according to claim 18, wherein forming a first vertical element of the spaced apart vertical elements comprises forming a plurality of linearly positioned conductive vias.

20. The method according to claim 18, wherein forming the second vertical element comprises electrically insulating the second vertical element from adjacent portions of the horizontal element and electrically connecting the second vertical element to said ground plane.

21. The method according to claim 16, further comprising connecting a coaxial feed cable to the first and second antenna feed points.

22. The method according to claim 21, wherein connecting the coaxial feed cable comprises connecting an outer conductor to the first antenna feed point, and an connecting an inner conductor to the second antenna feed point.

* * * * *